US009031449B2

(12) United States Patent
Goda et al.

(10) Patent No.: US 9,031,449 B2
(45) Date of Patent: May 12, 2015

(54) TONER COLLECTOR AND IMAGE FORMING APPARATUS INCLUDING SAME

(71) Applicant: KYOCERA Document Solutions Inc., Osaka-shi, Osaka (JP)

(72) Inventors: Mitsuhiro Goda, Osaka (JP); Hiroshi Inui, Osaka (JP); Koji Izumi, Osaka (JP); Naoki Mizutani, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/227,022

(22) Filed: Mar. 27, 2014

(65) Prior Publication Data

US 2014/0294427 A1 Oct. 2, 2014

(30) Foreign Application Priority Data

Mar. 28, 2013 (JP) ..... 2013-069783

(51) Int. Cl.

| | |
|---|---|
| ***G03G 21/00*** | (2006.01) |
| ***G03G 21/20*** | (2006.01) |
| ***G03G 21/10*** | (2006.01) |
| ***G03G 21/12*** | (2006.01) |

(52) U.S. Cl.

CPC ..... *G03G 21/206* (2013.01); *G03G 21/105* (2013.01); *G03G 21/12* (2013.01)

(58) Field of Classification Search

CPC ... G03G 21/206; G03G 21/007; G03G 21/20; G03G 21/00

USPC ..... 399/92, 93, 98, 99, 129, 264, 411

See application file for complete search history.

(56) References Cited

U.S. PATENT DOCUMENTS

| | | | | |
|---|---|---|---|---|
| 7,424,241 | B2 * | 9/2008 | Shirakata | 399/93 |
| 2005/0180772 | A1 * | 8/2005 | Dergham et al. | 399/92 |
| 2005/0271414 | A1 * | 12/2005 | Katayama et al. | 399/93 |
| 2007/0065171 | A1 * | 3/2007 | Koshimura et al. | 399/99 |
| 2008/0145092 | A1 * | 6/2008 | Tomatsu et al. | 399/93 |
| 2011/0211860 | A1 * | 9/2011 | Shimoyama et al. | 399/93 |
| 2012/0240534 | A1 * | 9/2012 | Ryuzaki | 55/385.4 |
| 2013/0101311 | A1 * | 4/2013 | Otsuka et al. | 399/93 |
| 2013/0243472 | A1 * | 9/2013 | Yamashita et al. | 399/98 |

FOREIGN PATENT DOCUMENTS

JP 2007-298782 11/2007

* cited by examiner

*Primary Examiner* — Francis Gray

(74) *Attorney, Agent, or Firm* — Gerald E. Hespos; Michael J. Porco; Matthew T. Hespos

(57) ABSTRACT

A toner collector includes a housing, an inlet port, a fan, a discharge port, a first upstream side filter, and a downstream side filter. The inlet port is opened in the housing. The fan is disposed in the housing, and intakes and discharges the airflow having flowed in through the inlet port. The discharge port is provided to the fan. The first upstream side filter is disposed on an upstream side of the fan in a direction of the airflow, and captures the toner and allows passage of the airflow. The downstream side filter is disposed on a downstream side of the discharge port in the direction of the airflow, and allows passage of the airflow discharged from the discharge port and captures the toner. The downstream side filter has a larger cross-sectional area of a cross section perpendicular to the direction of the airflow than the discharge port.

16 Claims, 10 Drawing Sheets

TONER COLLECTOR AND IMAGE FORMING APPARATUS INCLUDING SAME

This application is based on Japanese Patent Application No. 2013-069783 filed to JPO on Mar. 28, 2013, the contents of which are hereby incorporated by reference.

BACKGROUND

The present disclosure relates to a toner collector used in an image forming apparatus such as a printer and collects toner, and to an image forming apparatus including the same.

In electrophotographic image forming apparatuses such as a copier, a printer, and a fax machine, toner is supplied to an electrostatic latent image formed on an image carrier (a photosensitive drum and a transfer belt, for example), and the electrostatic latent image is developed, whereby a toner image is formed on the image carrier. The toner is stored in a developing device, and is supplied to the image carrier through a developing roller disposed in the developing device.

Image forming apparatuses including a dust collector (toner collector) for collecting scattered toner have conventionally been known. This technique has, however, the following problem. Specifically, scattered toner drops from a filter due to the vibration of a vibrating mechanism and clogs a lower section of the filter, causing the collection performance for the scattered toner to be degraded.

An object of the present disclosure is to provide a toner collector that can prevent the filter from clogging and can stably collect the toner, and an image forming apparatus including the same.

SUMMARY

A toner collector according to an aspect of the present disclosure includes a housing, an inlet port, a fan, a discharge port, a first upstream side filter, and a downstream side filter. The inlet port is opened in the housing. Toner flows through the inlet port together with an airflow. The fan is disposed in the housing, and intakes and discharges the airflow having flowed in through the inlet port. The discharge port is provided to the fan. The airflow is discharged through the discharge port. The first upstream side filter is disposed on an upstream side of the fan in a direction of the airflow, and captures the toner and allows passage of the airflow. The downstream side filter is disposed on a downstream side of the discharge port in the direction of the airflow, and allows passage of the airflow discharged from the discharge port and captures the toner. The downstream side filter has a larger cross-sectional area of a cross section perpendicular to the direction of the airflow than the discharge port.

An image forming apparatus according to another aspect of the present disclosure includes an image forming section, the toner collector, and a collection duct. The image forming section forms a toner image on a sheet. The collection duct collects unnecessary toner in or around the image forming section together with an airflow, so that the unnecessary toner and the airflow flow through the inlet port.

DETAILED DESCRIPTION

Figure 1:
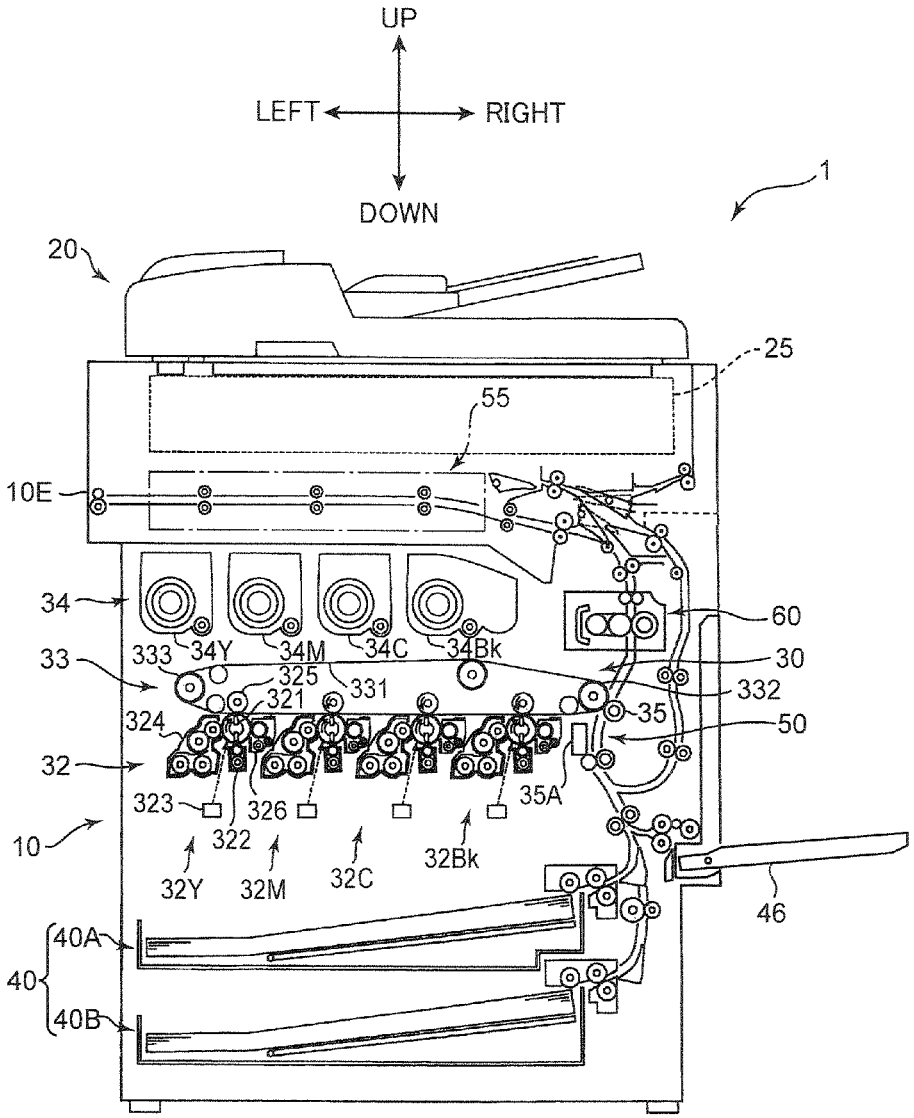
FIG. 1 is a cross-sectional view showing an inner structure of an image forming apparatus according to an embodiment of the present disclosure.

Embodiments of the present disclosure will be described in detail below based on the drawings. FIG. 1 is a cross-sectional view showing an inner structure of an image forming apparatus 1 according to an embodiment of the present disclosure. Here, a multifunction peripheral having a printing function and a copying function is described as an example of the image forming apparatus 1. Alternatively, the image forming apparatus may be a printer, a copier, or a fax machine.

<Description of Image Forming Apparatus>

The image forming apparatus 1 includes an apparatus main body 10 having an approximately rectangular parallelepiped casing structure and an automatic document feeder 20 disposed on the apparatus main body 10. The apparatus main body 10 incorporates a reading unit 25, an image forming section 30, a fixing section 60, a sheet feeder 40 (sheet accommodating unit), a conveyance path 50, and a conveyance unit 55. The reading unit 25 optically reads a document image to be copied. The image forming section 30 forms a toner image on a sheet. The fixing section 60 fixes the toner image on the sheet. The sheet feeder 40 stores a sheet to be conveyed to the image forming section 30. The conveyance path 50 conveys the sheet from the sheet feeder 40, or a feeding tray 46, to a sheet discharge port 10E, through the image forming section 30 and the fixing section 60. The conveyance unit 55 incorporates a sheet conveyance path as a part of the conveyance path 50.

The image forming section 30 forms a full color toner image and transfers the full color toner image onto the sheet. The image forming section 30 includes an image forming unit 32, an intermediate transfer unit 33, and a toner replenishing section 34. The image forming unit 32 includes four units 32Y, 32M, 32C, and 32Bk disposed in tandem and respectively form yellow (Y), magenta (M), cyan (C), and black (Bk) toner images. The intermediate transfer unit 33 is adjacently disposed on the image forming unit 32. The toner replenishing section 34 is disposed above the intermediate transfer unit 33.

Each of the image forming units 32Y, 32M, 32C, and 32Bk includes a photosensitive drum 321, as well as a charger 322, an exposure unit 323, a developing device 324, a primary transfer roller 325, and a cleaning device 326 disposed around the photosensitive drum 321.

The photosensitive drum 321 rotates about its axis, and carries an electrostatic latent image and a toner image on its circumferential surface. The charger 322 uniformly charges the surface of the photosensitive drum 321. The exposure unit 323 includes optical devices such as a laser light source, a mirror, and a lens. The exposure unit 323 irradiates the circumferential surface of the photosensitive drum 321 with light based on image data of the document image, to form the electrostatic latent image. The photosensitive drum 321 serves as an image carrier.

The developing device 324 supplies toner onto the circumferential surface of the photosensitive drum 321, to develop the electrostatic latent image formed on the photosensitive drum 321. The developing device 324 is for a two-component developer, and includes a screw feeder, a magnetic roller, and a developing roller. As illustrated in FIG. 1, the developing devices 324 of the respective colors are arranged side by side along a horizontal direction (left and right direction).

The primary transfer roller 325 forms a nip section with the photosensitive drum 321 disposed on the other side of an intermediate transfer belt 331 of the intermediate transfer unit 33. Thus, the toner image on the photosensitive drum 321 is primarily transferred onto the intermediate transfer belt 331 by the primary transfer roller 325. The cleaning device 326 includes a cleaning roller and the like, and cleans the circumferential surface of the photosensitive drum 321, after the toner is transferred.

The intermediate transfer unit 33 includes the intermediate transfer belt 331, a driving roller 332, and a driven roller 333. The intermediate transfer belt 331 is an endless belt wound around the driving roller 332 and the driven roller 333. The toner images from a plurality of photosensitive drums 321 are superimposed on each other and transferred at the same position of the outer circumferential surface of the intermediate transfer belt 331. The intermediate transfer belt 331 rotates in a counterclockwise direction in FIG. 1, and serves as an image carrier.

A secondary transfer roller 35 is disposed in opposition to the circumferential surface of the driving roller 332. The secondary transfer roller 35 transfers the toner image on the intermediate transfer belt 331 onto the sheet. The nip section formed by the driving roller 332 and the secondary transfer roller 35 serves as a secondary transfer section for transferring the full-color toner image obtained by superimposing the color toner images one over the other on the intermediate transfer belt 331 onto the sheet. A secondary transfer bias potential having the polarity opposite to that of the toner image is applied to one of the driving roller 332 and the secondary transfer roller 35, while the other one of the driving roller 332 and the secondary transfer roller 35 is grounded. A density sensor 35A is disposed at a position that is on the upstream side of the driving roller 332 in the rotating direction of the intermediate transfer belt 331, and in opposition to the circumferential surface of the intermediate transfer belt 331. The density sensor 35A outputs an electrical signal corresponding to the density of an image formed on the intermediate transfer belt 331.

The toner replenishing section 34 includes a yellow toner container 34Y, a magenta toner container 34M, a cyan toner container 34C, and a black toner container 34Bk. The toner containers 34Y, 34C, 34M, and 34Bk store the toner of their respective colors, and supply the toner of their respective colors to the developing devices 324 of the image forming units 32Y, 32M, 32C, and 32Bk of the respective colors Y, M, C, and Bk, through unillustrated supply paths.

The sheet feeder 40 includes sheet feeding cassettes 40A and 40B in two levels, accommodating sheets to be subjected to the image forming processing. The sheet feeding cassettes 40A and 40B can be drawn in the front direction from the front side of the apparatus main body 10. The sheet feeder 40 accommodates the sheets to be conveyed to the secondary transfer roller 35, and is disposed below the developing devices 324.

Figure 2:
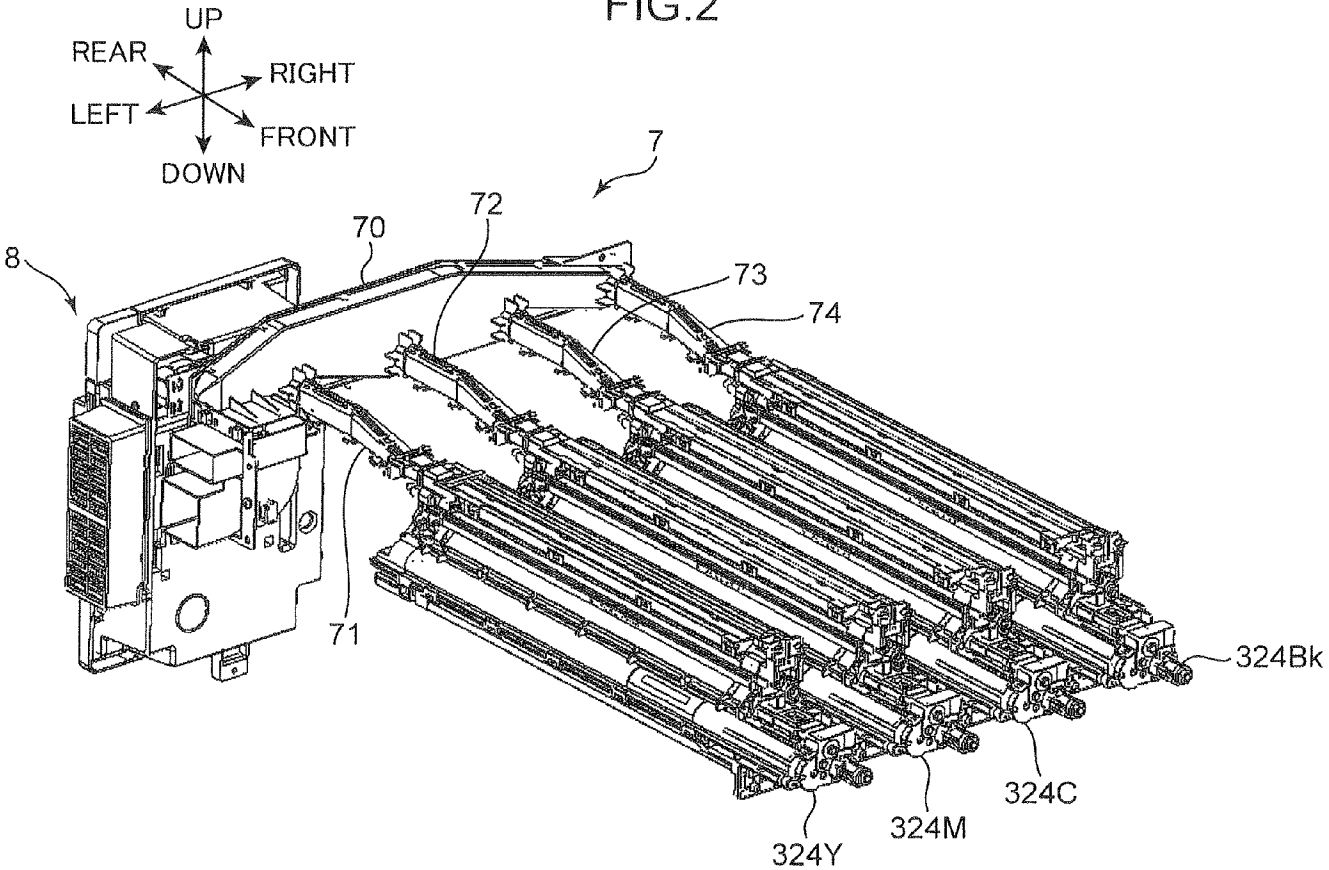
FIG. 2 is a perspective view of developing devices and a toner collector according to the embodiment of the present disclosure.
Figure 3:
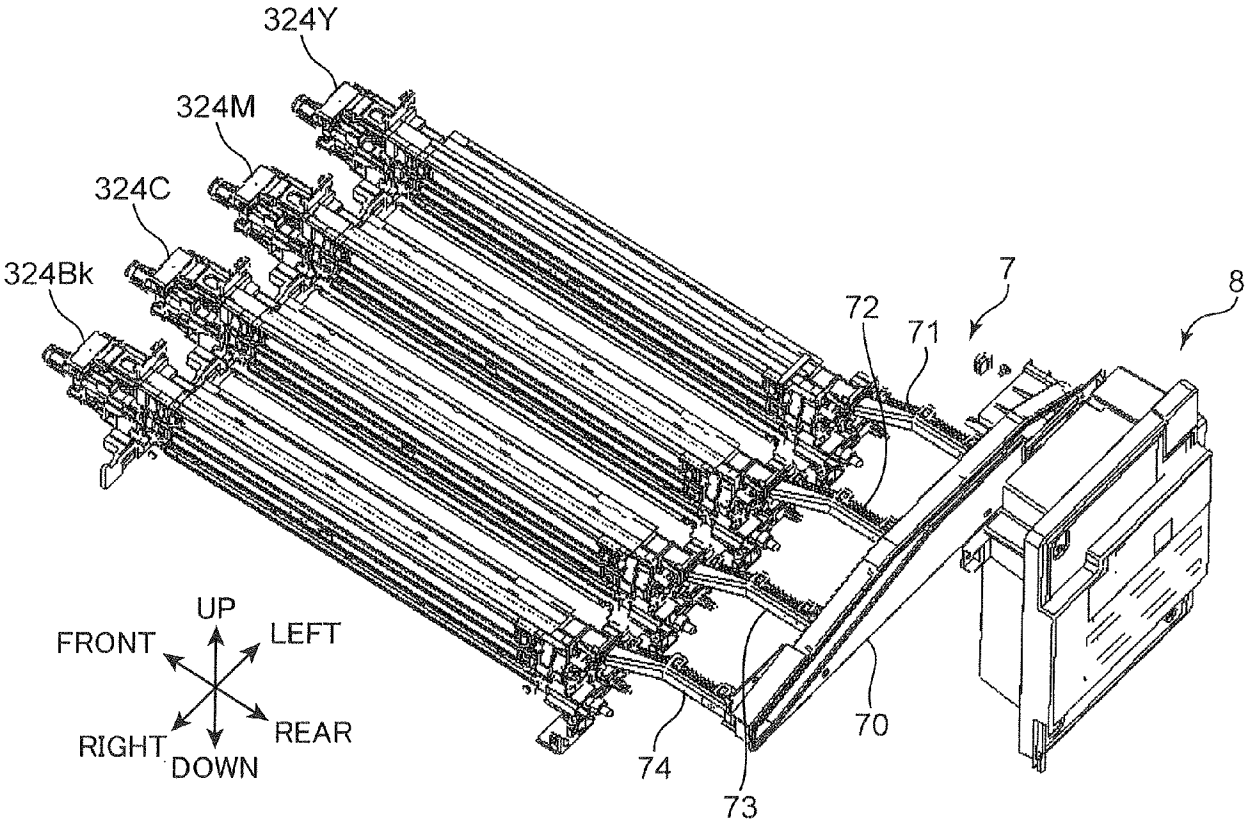
FIG. 3 is a perspective view of the developing devices and the toner collector according to the embodiment of the present disclosure.
Figure 4:
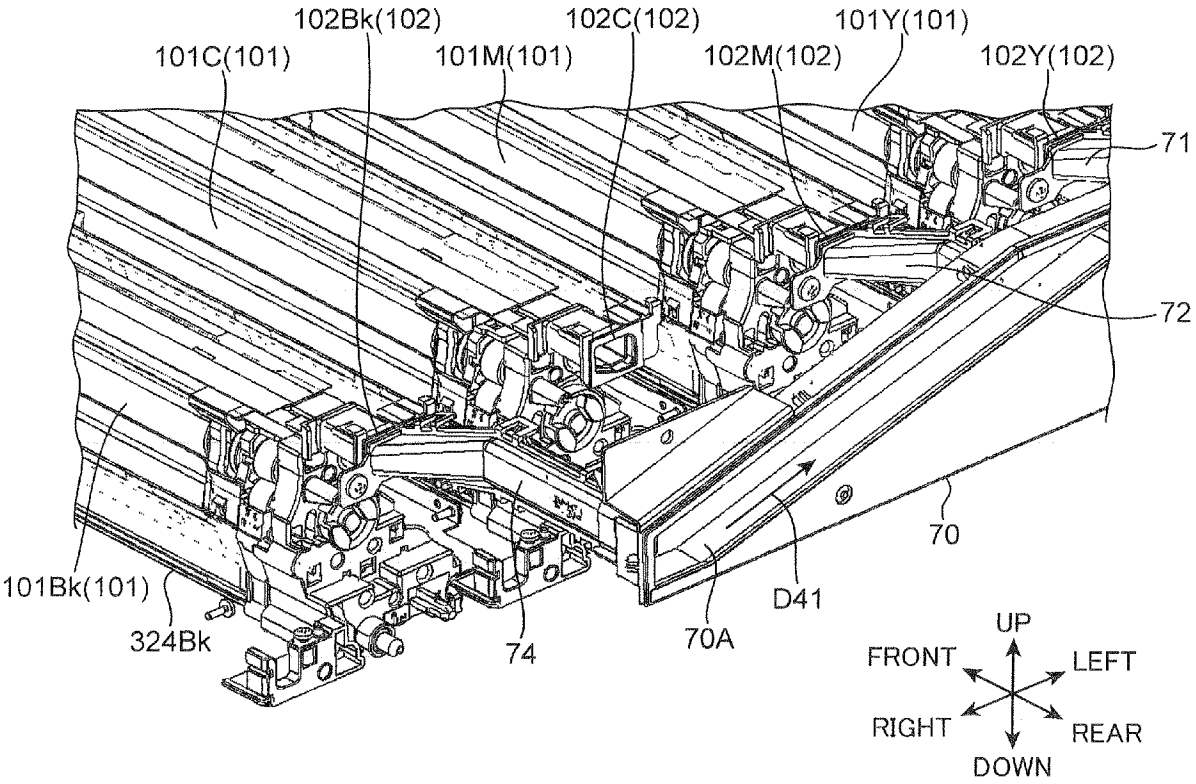
FIG. 4 is an enlarged perspective view of the developing devices and a collection duct according to the embodiment of the present disclosure.

The fixing section 60 is an induction heating fixing device that performs fixing processing for fixing the toner image on the sheet. The sheet passes through the fixing section 60, whereby toner image transferred onto the sheet is fixed on the sheet. The image forming apparatus 1 further includes a collection duct 7 and a toner collection unit 8 (toner collector). FIGS. 2 and 3 are perspective views of the developing devices 324, the collection duct 7, and the toner collection unit 8 according to the present embodiment. FIG. 4 is an enlarged perspective rear view of the developing devices 324 and the collection duct 7 according to the present embodiment.

Referring to FIGS. 2 and 3, the collection duct 7 is disposed behind the developing devices 324 of the respective colors (324Y, 324M, 324C, and 324Bk) that are arranged side by side. Unnecessary toner in or around the image forming section 30 is collected by the collection duct 7 to flow into an inlet port 800 of the toner collection unit 8 described later. In the present embodiment, the collection duct 7 collects the scattered toner together with the airflow from inside the developing device 324. Referring to FIG. 2, the collection duct 7 conveys the toner in an approximately horizontal direction from the developing devices 324. In an alternative embodiment, the collection duct 7 may collect toner scattered around the developing device 324. The collection duct 7 includes a main duct 70, a yellow duct 71, a magenta duct 72, a cyan duct 73, and a black duct 74. The main duct 70 extends in the left and right direction behind the developing devices 324. The main duct 70 incorporates a plurality of discharge air paths disposed in parallel with each other (see a black discharge air path 70A in FIG. 4). The toner collected from each of the developing devices 324 of the respective colors is conveyed through the corresponding one of the discharge air paths. The toner is collected from the inside of the developing devices 324 of the respective colors, through the yellow duct 71, the magenta duct 72, the cyan duct 73, and the black duct 74, to flow into the discharge air paths of the main duct 70.

Referring to FIG. 4, the developing device 324 of each color (324Y, 324M, 324C, and 324Bk) includes a developing roller 101 (101Y, 101M, 101C, and 101Bk). The developing roller 101 carries the toner on its circumferential surface, and supplies the toner to the photosensitive drum 321. The developing device 324 of each color incorporates an unillustrated screw that agitates the toner and supplies the toner to the developing roller 101. The developing device 324 of each color further includes a discharge port 102 (102Y, 102M, 102C, and 102Bk). The discharge port 102 is in communication with the inside of the developing device 324, and extends towards the rear side from the developing device 324. In FIG. 4, the cyan duct 73 is not illustrated, and thus the cyan discharge port 102C is exposed. The discharge ports 102 of the respective colors are coupled to the yellow duct 71, the magenta duct 72, the cyan duct 73, and the black duct 74. Thus, the airflow including the scattered toner is conveyed from the developing devices 324 to the main duct 70. As described above, the discharge air paths are disposed in parallel with each other in the main duct 70. The black discharge air path 70A is illustrated in FIG. 4. The discharge air paths of the other colors are similarly disposed in the main duct 70. The airflow having flowed into the black discharge air path 70A through the black duct 74 is guided to a left end portion of the main duct 70 as indicted by an arrow D41 in FIG. 4.

The toner collection unit 8 is coupled to the left end portion of the main duct 70. The toner collection unit 8 is disposed below the main duct 70.

<Structure of Toner Collection Unit>

Figure 5:
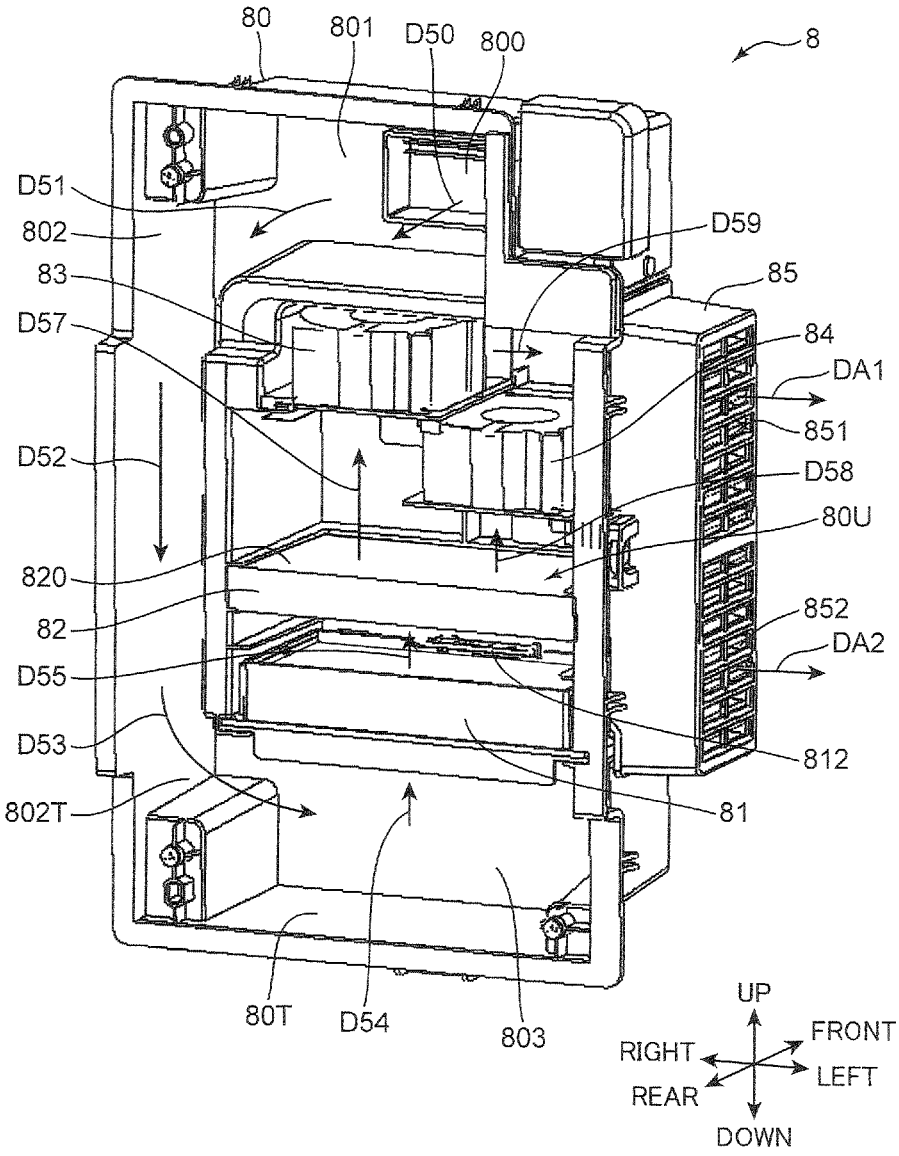
FIG. 5 is a perspective view showing the inside of a toner collection unit according to the embodiment of the present disclosure.
Figure 6:
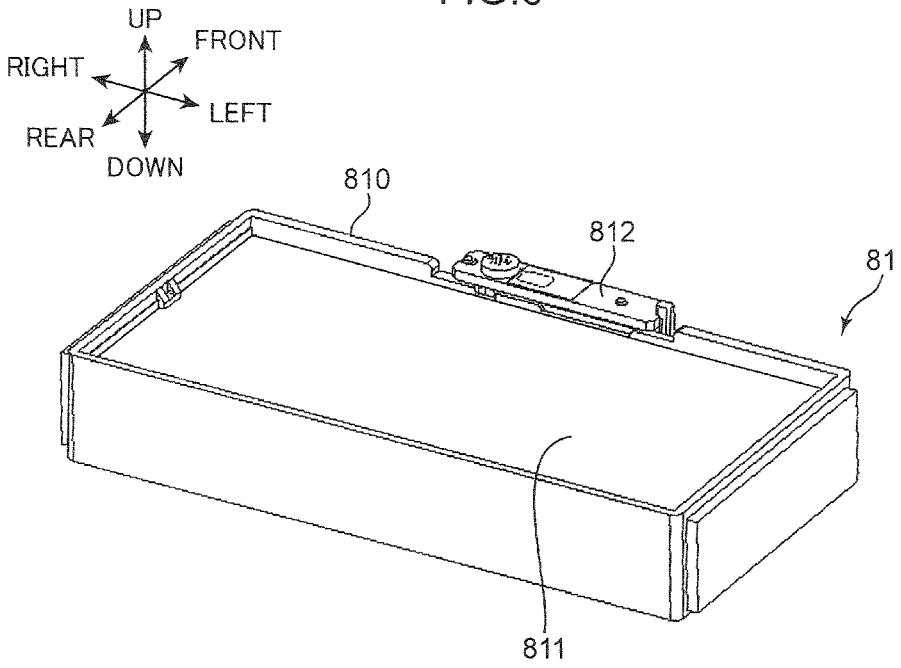
FIG. 6 is a perspective view of a first filter according to the embodiment of the present disclosure.

Next, the structure of the toner collection unit 8 according to a first embodiment of the present disclosure will be described by referring to FIGS. 5 and 6. FIG. 5 is a perspective view showing the inside of the toner collection unit 8 according to the present embodiment. FIG. 6 is a perspective view of a first filter section 81 according to the present embodiment.

Referring to FIG. 5, the toner collection unit 8 includes a housing 80, the first filter section 81 (first upstream side filter), a second filter section 82 (second upstream side filter), a first fan 83 (fan), a second fan 84 (fan), and a discharge section 85 (communication section).

The housing 80 has an approximately rectangular parallelepiped shape. The housing 80 defines the outer shape of the toner collection unit 8, and incorporates the first filter section 81, the second filter section 82, the first fan 83, and the second fan 84. The housing 80 incorporates a plurality of duct sections, to which the airflow is guided. The housing 80 includes the inlet port 800, an upper duct 801, a duct descending section 802, a duct ascending section 80U, and a bottom section 80T. The bottom section 80T is a bottom section of the housing 80 and defines the bottom surface of a lower duct 803 descried later.

The inlet port 800 is opened in the housing 80. The toner flows through the inlet port 800 together with the airflow. The inlet port 800 is disposed on an upper end side of the housing 80. The discharge air paths of the main duct 70 described above merge right before the inlet port 800, and communicate with the inlet port 800.

The upper duct 801 is a space formed in an upper end portion of the housing 80. The upper duct 801 faces the inlet port 800, and is in communication with the duct descending section 802.

The duct descending section 802 is in communication with a right end portion of the upper duct 801. Thus, the duct descending section 802 is in communication with the inlet port 800 through the upper duct 801, in the housing 80. The duct descending section 802 guides the airflow downward towards the bottom section 80T of the housing 80. The duct descending section 802 extends in the upper and lower direction in the right end portion of the housing 80.

The duct ascending section 80U is disposed next to the duct descending section 802 in the horizontal direction, in the housing 80. The duct ascending section 80U is in communication with the duct descending section 802 at the bottom section 80T, and guides the airflow upward. The duct ascending section 80U extends in the upper and lower direction from the bottom section 80T to a region where the first fan 83 is disposed. The duct ascending section 80U includes the lower duct 803 (guiding duct). The lower duct 803 is disposed between the inlet port 800 and the first and the second fans 83 and 84 in the direction of the airflow, and guides the airflow from the lower side to the upper side. The lower duct 803 is disposed in a lower portion of the duct ascending section 80U. As described above, the bottom section 80T defines the bottom surface of the lower duct 803.

The duct descending section 802 and the lower duct 803 of the duct ascending section 80U are in communication with each other through an introduction section 802T. In other words, the introduction section 802T guides the airflow having flowed in through the inlet port 800, into the lower duct 803 from a side portion (right side portion) of the lower duct 803. The bottom section 80T is disposed in the lower duct 803 below the introduction section 802T.

The first filter section 81 is disposed on the upstream side of the first and the second fans 83 and 84 in the direction of the airflow, and above the lower duct 803. The first filter section 81 has an entrance surface, through which the airflow enters, facing downward. The first filter section 81 captures the toner having flowed in together with the airflow through the inlet port 800, and allows the passage of the airflow. The first filter section 81 is disposed in a lower portion of the duct ascending section 80U. The first filter section 81 has a rectangular parallelepiped shape having a predetermined thickness in the upper and lower direction.

The second filter section 82 is disposed between the first and the second fans 83 and 84 and the first filter section 81, in the direction of the airflow. The second filter section 82 captures the toner which has failed to be captured by the first filter section 81, and allows the passage of the airflow. The second filter section 82 has a rectangular parallelepiped shape having a predetermined thickness in the upper and lower direction.

The first and the second fans 83 and 84 are disposed in the housing 80, and intake and discharge the airflow having flowed in through the inlet port 800. The first and the second fans 83 and 84 discharge the airflow having flowed in from below, towards the left. The first and the second fans 83 and 84 are disposed in an upper portion of the duct ascending section 80U. As shown in FIG. 5, the first and the second fans 83 and 84 are disposed on the upper side of the second filter section 82, while being apart from each other by a predetermined distance. The first fan 83 is disposed in a right side portion in the upper end portion of the duct ascending section 80U. The second fan 84 is disposed in a left side portion of the duct ascending section 80U, at a position offset towards below from the first fan 83 in the upper and lower direction. As described above, the plurality of fans are thus disposed in the upper portion of the duct descending section 80U in the present embodiment. The first and the second fans 83 and 84 are disposed at positions that do not overlap in the vertical direction. Thus, the discharge paths for the airflows, respectively discharged from the first and the second fans 83 and 84, are prevented from overlapping each other. In other words, with the first and the second fans 83 and 84 thus disposed, the airflow is distributed in the upper and lower direction to be efficiently discharged towards the left.

The discharge section 85 is disposed on the downstream side of the first and the second fans 83 and 84 in the direction of the airflow. The discharge section 85 guides the airflow in the horizontal direction (towards the left) to be discharged outside the housing 80. As shown in FIG. 5, the discharge section 85 is disposed on the left side surface of the housing 80 and faces the region covering from the first filter section 81 to the first fan 83.

The discharge section 85 includes an upper discharge filter 851 and a lower discharge filter 852 (downstream side filter). The upper and the lower discharge filters 851 and 852 are disposed on the downstream side of the first and the second fans 83 and 84 in the direction of the airflow. The upper and the lower discharge filters 851 and 852 capture the toner, and allow the passage of airflows discharged from discharge ports (83T and 84T) of the first and the second fans 83 and 84, described later. The airflows pass through the upper and the lower discharge filters 851 and 852, and then are discharged outside the housing 80. The upper discharge filter 851 faces the first and the second fans 83 and 84 in the horizontal direction. The lower discharge filter 852 is disposed below the upper discharge filter 851. The airflows discharged from the first and the second fans 83 and 84 are distributed in the vertical direction in the discharge section 85 and pass through the upper and the lower discharge filters 851 and 852 to be discharged outside the housing 80.

Referring to FIG. 6, the first filter section 81 includes a frame 810 (frame body), a first filter 811 (first upstream filter), and a vibration motor 812 (vibration unit). The frame 810 is supported by the housing 80 and accommodates the first filter 811. The frame 810 is disposed to surround four surfaces of the first filter 811 that face the horizontal direction. A known dust filter may be employed as the first filter 811. In the present embodiment, the first filter 811 includes an unillustrated paper filter of a predetermined density. The paper filter includes approximately 10% of glass fibers each having a diameter of 1 to 10 μm. The gap between the fibers is set to 10 to 50 μm. The vibration motor 812 is fixed on an upper end surface of a front side wall of the frame 810, and vibrates the first filter 811 through the frame 810.

Similarly, the second filter section 82 is formed by disposing a second filter 820 (second upstream side filter) (FIG. 5) in an unillustrated frame. The second filter 820, the upper discharge filter 851, and the lower discharge filter 852 are made of the dust filter similar to the first filter 811.

Next, how the airflow and the toner flow in the toner collection unit 8 will be described. When the power of the image forming apparatus 1 is turned ON, an unillustrated controller rotates the developing roller 101 of the developing device 324 and an unillustrated screw, and rotates the first and the second fans 83 and 84. As a result, the airflow including the toner is supplied from the developing device 324 to the toner collection unit 8 through the collection duct 7. The airflow having flowed into the housing 80 through the inlet port 800 (arrow D50 in FIG. 5) flows into the duct descending section 802 from the upper duct 801 (arrow D51). The airflow temporarily flows downward in the duct descending section 802 (arrow D52), and then flows into the lower duct 803 from the side portion of the lower duct 803 through the introduction section 802T (arrow D53). The lower duct 803 guides the airflow from the lower side to the upper side (arrow D54). When the airflow passes through the first filter 811 of the first filter section 81 disposed above the lower duct 803, the toner is captured by the first filter 811. The airflow that has passed through the first filter 811 (arrow D55) passes through the second filter 820 of the second filter section 82. Here, the toner which has failed to be captured by the first filter 811 is captured by the second filter 820.

The airflow that has passed through the second filter 820 of the second filter section 82 flows into the first and the second fans 83 and 84 (arrows D57 and D58) respectively on the right and the left sides of the duct ascending section 80U. The airflow is discharged towards the left by the first and the second fans 83 and 84 (arrow D59). Then, the airflow flows into the discharge section 85, and passes through the upper and the lower discharge filters 851 and 852 to be discharged outside the housing 80 (arrows DA1 and DA2).

As described above, in the present embodiment, the toner having flowed into the housing 80 together with the airflow is captured by the first filter section 81 disposed on the upstream side of the first and the second fans 83 and 84. The second filter section 82 and the upper and the lower discharge filters 851 and 852 are respectively disposed on the upstream side and the downstream side of the first and the second fans 83 and 84, in the direction of the airflow. Thus, the toner is surely collected, and the attempt to prevent the toner from being discharged outside the housing 80 is further facilitated. Specifically, the plurality of filters are disposed on the upstream side of the first and the second fans 83 and 84. Thus, the upper and the lower discharge filters 851 and 852, disposed on the downstream side of the first and the second fans 83 and 84, are prevented from clogging. Thus, the contamination inside or outside the image forming apparatus 1, due to the scattered toner, is favorably prevented. Preferably, the relationship A2≥A1≥A3 is satisfied, where A1 is the passage amount of the airflow through the first filter 811 of the first filter section 81, A2 is the passage amount through the second filter 820 of the second filter section 82, and A3 is the passage amount through the upper and the lower discharge filters 851 and 852. When the relationship is satisfied, the airflow towards the first and the second fans 83 and 84 is surely formed, and the first and the second filters 811 and 820 on the upstream side favorably capture the toner.

When the toner collection unit 8 is used, the first filter 811 of the first filter section 81, disposed on the most upstream side in the direction of the airflow, captures a large amount of toner. Thus, when the first filter 811 is clogged, the toner collection performance is degraded. Thus, in the present embodiment, the controller drives the vibration motor 812 while the first and the second fans 83 and 84 are not rotating. When the vibration motor 812 is driven, the first filter 811 is vibrated through the frame 810 (FIG. 6). As result, the toner, especially the one attached to the lower surface of the first filter 811, drops downward by the vibration. As described above, in the present embodiment, the vibration can surely reach the first filter 811 by vibrating the frame 810.

The first filter 811 is disposed to have the entrance surface, through which the airflow enters, facing downward. Thus, the dropped toner can be prevented from reattaching to the first filter 811. As a result, clogging of the first filter 811 is prevented as much as possible, and the toner can be stably collected. As described above, the introduction section 802T guides the airflow, having flowed in through the inlet port 800, into the lower duct 803 from the side portion of the lower duct 803. The toner dropped from the first filter 811 by the vibration of the vibration motor 812 is stored in the bottom section 80T. The bottom section 80T is disposed in the lower duct 803 below the introduction section 802T. Thus, the toner stored in the bottom section 80T does not blocking the airflow flowing to the lower duct 803.

The arrangement of the toner collection unit 8 in the image forming apparatus 1 is described by referring to FIGS. 1, 2 and 5. The duct descending section 802 and the duct ascending section 80U of the housing 80, are disposed next to each other in the horizontal direction, in the housing 80. The airflow, having flowed in through the inlet port 800, temporarily descends in the duct descending section 802, and then ascends in the duct ascending section 80U. Thus, the airflow can surely be an ascending current. The duct descending section 802 and the duct ascending section 80U are disposed next to each other in the housing 80. Thus, the space saving of the housing 80 is achieved.

Furthermore, the sheet feeder 40 of the image forming apparatus 1 is disposed below the developing device 324. The inlet port 800 of the toner collection unit 8 is disposed at approximately the same level as the developing devices 324 in the vertical direction. The duct descending section 802 and the duct ascending section 80U of the toner collection unit 8 face the sheet feeder 40 in the horizontal direction. Thus, the airflow having flowed in through the inlet port 800 can surely be the ascending current behind the developing devices 324, due to the height of the sheet feeder 40 of the image forming apparatus 1.

<Structure of Discharge Section>

Figure 7:
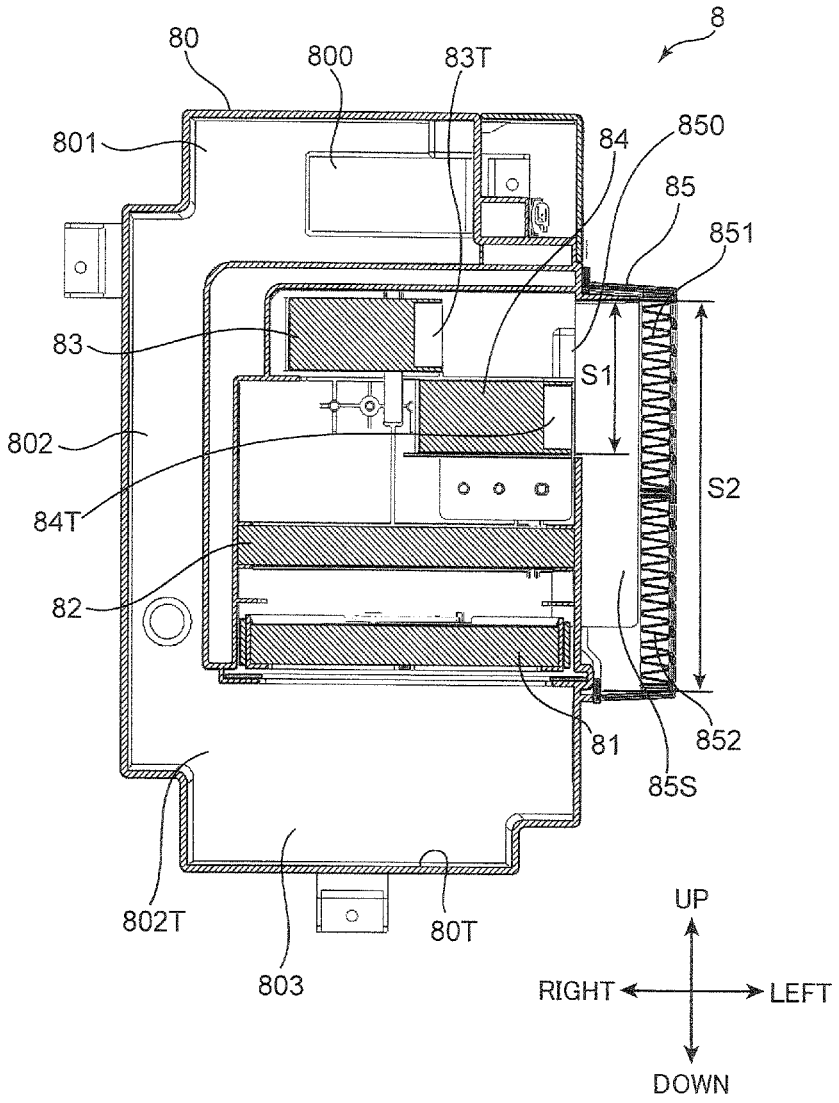
FIG. 7 is a cross-sectional view showing the inside of the toner collection unit according to the embodiment of the present disclosure.
Figure 8:
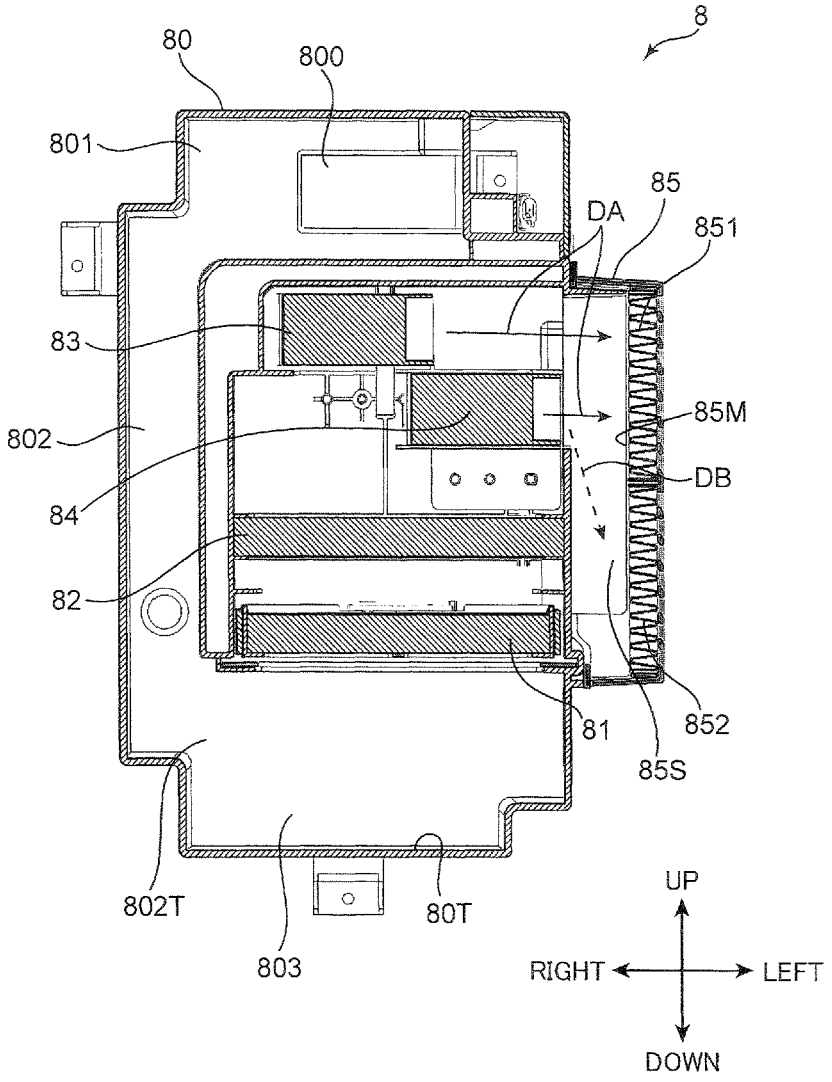
FIG. 8 is a cross-sectional view showing the inside of the toner collection unit according to the embodiment of the present disclosure.

Next the structure of the discharge section 85 according to the present embodiment is further described by referring to FIGS. 7 and 8. FIGS. 7 and 8 are cross-sectional views of the toner collection unit 8. As shown in FIG. 7, the first and the second fans 83 and 84 respectively include the first and the second discharge ports 83T and 84T (both of which are discharge ports). The first and the second discharge ports 83T and 84T are disposed to the first and the second fans 83 and 84, and are discharge ports through which the airflow is discharged. The first and the second discharge ports 83T and 84T are opened on the left side of the first and the second fans 83 and 84, towards the left. The airflows respectively discharged from the first and the second discharge ports 83T and 84T merge in a merging discharge port 850 opened in the left side surface of the housing 80. In other words, the merging discharge port 850 serves as a discharge port, to which the airflow from a fan including the first and the second fans 83 and 84 are discharged. The merging discharge port 850 has a cross section having a cross-sectional area S1. The cross section is perpendicular to the direction of the airflow discharged from the first and the second fans 83 and 84 (direction of arrow DA in FIG. 8, left direction, discharge direction).

Furthermore, the discharge section 85 (communication section) incorporates a communication space 85S. The communication space 85S is a region where the communication between the first and second fans 83 and 84 and the upper and the lower discharge filters 851 and 852 is established, and where the airflow flows. As shown in FIG. 7, the communication space 85S with an expanded area is formed below the merging discharge port 850, and is in communication with the upper and the lower discharge filters 851 and 852. Thus, the air discharged from the merging discharge port 850 flows into the upper and the lower discharge filters 851 and 852 through the communication space 85S of the discharge section 85.

Referring to FIG. 8, the upper and the lower discharge filters 851 and 852 have a facing surface 85M on the right side surface. The facing surface 85M faces the communication space 85S. In the present embodiment, the upper and the lower discharge filters 851 and 852 have cross sections having a total cross-sectional area of S2. The cross sections are perpendicular to the direction of the airflow (direction of arrow DA in FIG. 8) passing through the upper and the lower discharge filters 851 and 852. The cross-sectional area S2 of the upper and the lower discharge filters 851 and 852 is set to be larger than the cross-sectional area S1 of the merging discharge port 850. More specifically, the communication space 85S is a rectangular parallelepiped space having the merging discharge port 850 on the upper end side of the right side surface, and having the left side surface facing the upper and the lower discharge filters 851 and 852.

The toner flows in through the inlet port 800 together with the airflow, and is captured by the first and the second filter sections 81 and 82. With the relationship between the cross-sectional areas, the upper and the lower discharge filters 851 and 852 are prevented from being entirely clogged, even when the toner remains in the airflow discharged from the first and the second fans 83 and 84. As a result, the airflow is stably discharged from the upper and the lower discharge filters 851 and 852, and thus the airflow stably flows into the housing 80 through the inlet port 800. Thus, the toner collection performance of the toner collection unit 8 is stably maintained.

In particular, in the present embodiment, the upper and the lower discharge filters 851 and 852 are disposed to be perpendicular to the discharge direction (direction of arrow DA in FIG. 8). The discharge filter 851 is disposed to face the first and the second fans 83 and 84 in the discharge direction. The lower discharge filter 852 continues from a lower portion of the upper discharge filter 851. Thus, in an early stage of the toner collection unit 8 in use, the airflow discharged from the first and the second fans 83 and 84 mainly passes through the upper discharge filter 851 (arrow DA), and the toner is mainly collected by the first and the second filter sections 81 and 82. The toner remaining in the airflow discharged from the first and the second fans 83 and 84 is captured by the upper discharge filter 851. As a result, even when the upper discharge filter 851 is clogged by the toner, the airflow discharged from the first and the second fans 83 and 84 can flow into the lower discharge filter 852 (arrow DB in FIG. 8). Thus, the airflow is stably discharged from the lower discharge filter 852, whereby the airflow stably flows into the housing 80 through the inlet port 800. As a result, the toner collection performance of the toner collection unit 8 is stably maintained.

Figure 9:
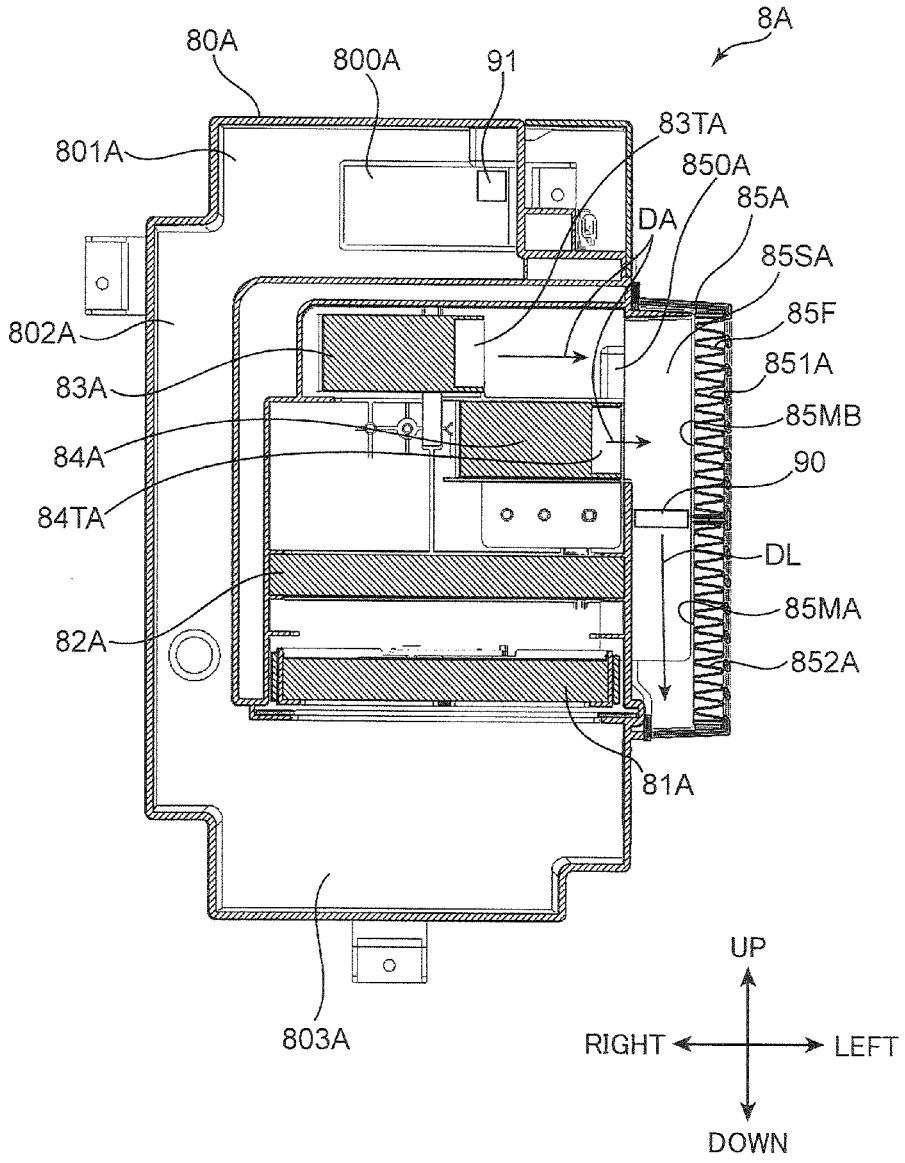
FIG. 9 is a cross-sectional view showing the inside of a toner collection unit according to another embodiment of the present disclosure.
Figure 10:
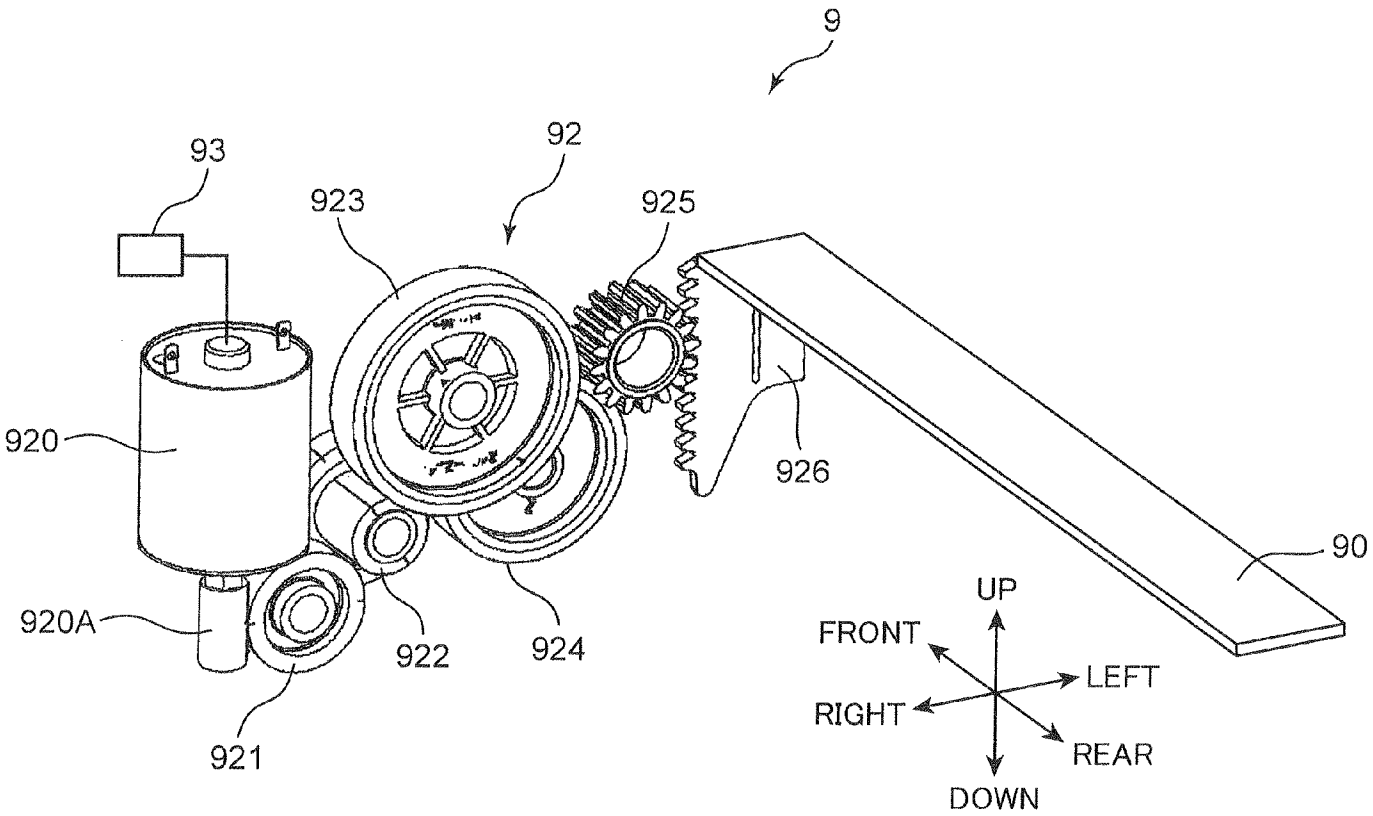
FIG. 10 is a perspective view of a movement unit of a partitioning member according to the other embodiment of the present disclosure.

Next, a toner collection unit 8A according to a second embodiment of the present disclosure will be described by referring to FIGS. 9 and 10. FIG. 9 is a cross-sectional view showing the inside of a toner collection unit 8A according to the present embodiment. FIG. 10 is a perspective view of a communication region changing section 9 of the toner collection unit 8A.

Referring to FIG. 9, the toner collection unit 8A includes a housing 80A, similarly to the toner collection unit 8 according to the preceding embodiment. The housing 80A is different from the housing 80 according to the preceding embodiment, in the structure of a discharge section 85A, and in that the communication region changing section 9 is provided. The differences are mainly described, and the description of other points will be omitted. In FIG. 9, the components that are the same as the counterparts in the preceding first embodiment (FIG. 8) are denoted with the same reference numerals with "A" in the end.

The housing 80A includes first and second fans 83A and 84A. The first and the second fans 83A and 84A respectively include first and second discharge ports 83TA and 84TA, through which the airflow is discharged. The airflows discharged from the first and the second discharge ports 83TA and 84TA merge at a merging discharge port 850A.

The housing 80A includes a discharge filter 85F (downstream side filter). The discharge filter 85F is disposed on the downstream side of the merging discharge port 850A in the direction of the airflow, and captures the toner. The airflow passes through the discharge filter 85F, and then is discharged outside the housing 80A. The discharge filter 85F includes an upper discharge filter 851A and a lower discharge filter 852A, respectively on upper and lower sides.

The housing 80A includes a discharge section 85A including a communication space 85SA establishing the communication between the merging discharge port 850A and the discharge filter 85F. The discharge filter 85F includes a facing surface 85MA facing the communication space 85SA. The facing surface 85MA of the discharge filter 85F is perpendicular to the discharge direction (arrow DA in FIG. 9) of the airflow discharged from the merging discharge port 850A, and faces the merging discharge port 850A in the discharge direction. The discharge direction is a direction along a horizontal plane. The facing surface 85MA is disposed below the merging discharge port 850A in the vertical direction and is set to be wider than the merging discharge port 850A. In FIG. 9, a lower side portion of the facing surface 85MA is indicated by an arrow. The facing surface 85MA extends from the upper end section of the upper discharge filter 851A to the lower end section of the lower discharge filter 852A, and faces the communication space 85SA.

The toner collection unit 8A further includes the communication region changing section 9 (FIG. 10). The communication region changing section 9 changes the area of a communication region 85MB of the facing surface MA, in communication with the communication space 85SA. The communication region changing section 9 includes a partitioning member 90, an airflow meter 91 (airflow amount detector), and a movement unit 92.

The partitioning member 90 (FIGS. 9 and 10) is disposed in the discharge section 85A. The partitioning member 90 defines a surface of the communication space 85SA along the discharge direction. More specifically, the partitioning member 90 is a plate shaped member having a predetermined width in the left and right direction, and long extending in the front and rear direction. The surface of the partitioning member 90 facing the vertical direction defines the lower surface of the communication space 85SA. The airflow discharged from the merging discharge port 850A passes through the communication space 85SA having the lower side defined by the partitioning member 90, to be guided to the discharge filter 85F. Here, a region which is on the facing surface 85MA of the discharge filter 85F and is in communication with the communication space 85SA is defined as the communication region 85MB. The communication region 85MB is a surface as a part of the facing surface 85MA, covering from the upper end section of the upper discharge filter 851A to the section of the facing surface 85MA defined by the partitioning member 90, and facing the communication space 85SA.

The airflow meter 91 is disposed on the upstream side of the first and the second fans 83A and 84A in the direction of the airflow, and detects the amount of the airflow. The airflow meter 91 is disposed on one corner of the inlet port 800A.

The movement unit 92 moves the partitioning member 90 in a direction crossing the discharge direction. More specifically, the movement unit 92 moves the partitioning member 90 in the vertical direction. When the movement unit 92 moves the partitioning member 90 in the vertical direction, the area of the communication region 85MB in communication with the communication space 85SA changes. More specifically, the area increases when the partitioning member 90 moves downward, and decreases when the partitioning member 90 moves upward.

The movement unit 92 includes a motor 920, a first gear 921, a second gear 922, a third gear 923, a fourth gear 924, a driving gear 925, and a rack 926. The motor 920 generates driving force for moving the partitioning member 90 in the vertical direction. The motor 920 includes a driving shaft 920A. The first gear 921 is coupled to the driving shaft 920A of the motor 920. The driving force of the motor 920 is transmitted to the first to the fourth gears 921 to 924, and then is transmitted to the driving gear 925. The rotation of the driving gear 925 is converted into the vertical movement of the rack 926 engaged with the driving gear 925. Thus, the partitioning member 90 fixed to the upper end section of the rack 926 vertically moves in the discharge section 85A.

The toner collection unit 8A further includes a first controller 93. The first controller 93 causes the communication region changing section 9 to change the area of the communication region 85MB, in accordance with the result of detecting the amount of the airflow by the airflow meter 91. More specifically, the first controller 93 increases the area of the communication region 85MB when the airflow amount detected by the airflow meter 91 is reduced. The first controller 93 reduces the area of the region of the communication region 85MB when the airflow amount detected by the airflow meter 91 is increased, after the discharge filter 85F is maintained.

In an early stage of the toner collection unit 8 in use, as shown in FIG. 9, the partitioning member 90 is disposed between the upper and the lower discharge filters 851A and 852A of the discharge filter 85F. The scattered toner flowing in through the inlet port 800A is mainly captured by first and the second filter sections 81A and 82A. When a slight amount of toner, which has failed to be captured, flows into the first and the second fans 83A and 84A, the toner is captured by the upper discharge filter 851A. When the upper discharge filter 851A is clogged, the air intake amounts of the first and the second fans 83A and 84A are reduced. As a result, the airflow amount detected by the airflow meter 91 disposed at the inlet port 800A is reduced. Here, the first controller 93 controls the communication region changing section 9 so that the area of the communication region 85MB in the discharge filter 85F, in communication with the communication space 85SA, is increased. Thus, the cross-sectional area for the air discharged from the merging discharge port 850A to pass through the discharge filter 85F can be changed. More specifically, the first controller 93 rotates the motor 920 of the movement unit 92 of the communication region changing section 9, so that the rack 926 moves downward. As a result, the partitioning member 90 moves vertically downward in the discharge section 85A (arrow DL in FIG. 9). Thus, the area of the communication region 85MB expands vertically downward. As a result, the communication between the lower discharge filter 852A and the communication space 85SA is established, whereby a new filter surface is exposed.

As described above, in the present embodiment, when the discharge filter 85F is partially clogged and the air intake amounts of the first and the second fans 83A and 84A are reduced, the area of the communication region 85MB is increased in accordance with the amount of the airflow flowing towards the first and the second fans 83A and 84A. Specifically, the area of the communication region 85MB changes in the vertical direction by the vertical movement of the partitioning member 90. Thus, the intake amounts of the first and the second fans 83A and 84A can be restored. As a result, the airflows are stably discharged from the first and the second fans 83A and 84A, whereby the airflow stably flows into the housing 80A through the inlet port 800A. Thus, the toner collection performance of the toner collection unit 8A is maintained. Furthermore, the contamination inside and outside the image forming apparatus 1 by the toner can be favorably prevented.

The toner collection units 8 and 8A according to the embodiments of the present disclosure, as well as the image forming apparatus 1 including the same, have been described above. The present disclosure is not limited to these, and the following modifications can be made for example.

(1) In the second embodiment, a mode is described where the first controller 93 moves the partitioning member 90 in accordance with the amount detected by the airflow meter 91. The present disclosure is not limited to this. The image forming apparatus 1 may include another controller (second controller) not illustrated in the figures, instead of the first controller 93. Here, the controller may cause the communication region changing section 9 to change the area of the communication region 85MB in accordance with use conditions of the image forming section 30. Specifically, the image forming apparatus 1 includes an image density detector that detects an image density of the toner image formed on the photosensitive drum 321. The controller causes the communication region changing section 9 to change the area of the communication region 85MB in accordance with the detection result of the image density detector. Specifically, the controller sets the area of the communication region 85MB to be larger as the image density detected by the image density detector increases. In such a structure, the area of the communication region 85MB can be changed in accordance with the use conditions of the image forming section 30. In particular, the discharge filter 85F can be prevented from being entirely clogged by the toner, even when the image density of the toner image is high, and the amount of toner that flows into the toner collection unit 8A is large. As a result, the airflow is stably discharged from the first and the second fans 83A and 84A, whereby the airflow stably flows into the housing 80A through the inlet port 800A. Thus, the toner collection performance is maintained, and the contamination inside and outside the image forming apparatus 1 by the toner can be favorably prevented.

(2) In the second embodiment described above, a mode is described where the facing surface 85MA of the discharge filter 85F is set to be wider than the merging discharge port 850A in the vertical direction, the surface of the partitioning member 90 facing the vertical direction defines the communication space 85SA, and the movement unit 92 moves the partitioning member 90 in the vertical direction. The present disclosure is not limited to this. When the discharge direction of the first and the second fans 83A and 84A is along the horizontal plane, the facing surface 85MA may be set to be wider than the merging discharge port 850A in the width direction (front and rear direction) perpendicular to the discharge direction and the vertical direction. Here, the surface of the partitioning member 90 facing the width direction defines the communication space 85Sa, and the movement unit 92 moves the partitioning member 90 in the width direction. In such a case, the movement of the partitioning member 90 in the width direction changes the area of the communication space 85SA in the width direction. As a result, the area of the communication region 85MB is favorably changed, whereby the collection performance of the toner collection unit 8A is stably maintained.

(3) In the embodiments, a mode is described where the airflow is discharged from the discharge section 85 in the horizontal direction. The present disclosure is not limited to this. The airflow may be discharged from the discharge section 85 in a different direction. Furthermore, the number of fans, represented by the first and the second fans 83 and 84, is not limited to two.

(4) In the embodiments, the vibration motor 812 is described as an example of the vibration unit that vibrates the first filter 811. The present disclosure is not limited to this. A solenoid or a cam member in contact with the first filter 811 or the frame 810 may be employed as the vibration unit.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A toner collector comprising:

a housing;

an inlet port that is opened in the housing and through which toner flows together with an airflow;

a fan disposed in the housing, the fan intaking and discharging the airflow having flowed in through the inlet port;

a discharge port that is provided to the fan and through which the airflow is discharged;

an upstream side filter disposed on an upstream side of the fan in a direction of the airflow, the upstream side filter capturing the toner and allowing passage of the airflow; and a downstream side filter disposed on a downstream side of the discharge port in the direction of the airflow, the downstream side filter allowing the passage of the airflow discharged from the discharge port and capturing the toner, the downstream side filter having a cross section perpendicular to the direction of the airflow that is larger than than the discharge port, the downstream side filter having a facing surface disposed to be perpendicular to a discharge direction of the airflow discharged from the discharge port, and facing the discharge port in the discharge direction, a communication section including a communication space where communication between the discharge port and the downstream side filter is established and where the airflow flows, the facing surface of the downstream side filter facing the communication space; and a communication region changing section that changes an area of a communication region of the facing surface, the communication region being in communication with the communication space, the communication region changing section includes:

a partitioning member that defines a surface of the communication space along the discharge direction; and a movement unit that moves the partitioning member in a direction crossing the discharge direction, and the area of the communication region is changed by the movement of the partitioning member.

2. The toner collector according to claim 1, wherein the discharge direction is along a horizontal plane, the facing surface is set to be wider than the discharge port in a vertical direction, a surface, of the partitioning member, facing the vertical direction defines the communication space, and the movement unit moves the partitioning member in the vertical direction.

3. The toner collector according to claim 1, wherein the discharge direction is along a horizontal plane, the facing surface is set to be wider than the discharge port in a width direction perpendicular to the discharge direction and a vertical direction, a surface, of the partitioning member, facing the width direction defines the communication space, and the movement unit moves the partitioning member in the width direction.

4. The toner collector according to claim 1, further comprising:

an airflow amount detector that is disposed on the upstream side of the fan in the direction of the airflow, and detects an amount of the airflow; and a first controller that causes the communication region changing section to change the area of the communication region in accordance with a detection result of the airflow amount detector.

5. The toner collector according to claim 4, wherein the first controller increases the area of the communication region when the amount detected by the airflow amount detector is reduced.

6. A toner collector comprising:

a housing;

an inlet port that is opened in the housing and through which toner flows together with an airflow;

a fan that is disposed in the housing, the fan intaking and discharging the airflow having flowed in through the inlet port;

a discharge port that is provided to the fan and through which the airflow is discharged;

an upstream side filter disposed on an upstream side of the fan in a direction of the airflow, the upstream side filter capturing the toner and allowing passage of the airflow; and a downstream side filter disposed on a downstream side of the discharge port in the direction of the airflow, the downstream side filter allowing the passage of the airflow discharged from the discharge port and capturing the toner, the downstream side filter having a cross section perpendicular to the direction of the airflow with a cross-sectional area that is larger than the discharge port;

a guiding duct section that is disposed between the inlet port and the fan in the direction of the airflow, and guides the airflow from a lower side to an upper side; and a vibration unit that vibrates the upstream side filter, where the upstream side filter is disposed above the guiding duct section, with an entrance surface through which the airflow enters facing downward.

7. The toner collector according to claim 6, further comprising:

a communication section including a communication space where communication between the discharge port and the downstream side filter is established and where the airflow flows.

8. The toner collector according to claim 7, wherein the downstream side filter includes a facing surface facing the communication space, and the toner collector further comprises a communication region changing section that changes an area of a communication region of the facing surface, the communication region being in communication with the communication space.

9. The toner collector according to claim 6, further comprising:

a second upstream side filter disposed between the fan and the first upstream side filter in the direction of the airflow, and captures the toner and allows the passage of the airflow.

10. An image forming apparatus comprising:

an image forming section that forms a toner image on a sheet;

a toner collector including an inlet port; and a collection duct that collects unnecessary toner in or around the image forming section together with an airflow, so that the unnecessary toner and the airflow flow through the inlet port, wherein the toner collector includes:

a housing, the inlet port being opened in the housing and the toner flowing through the inlet port together with an airflow;

a fan disposed in the housing, the fan intaking and discharging the airflow having flowed in through the inlet port;

a discharge port that is provided to the fan and through which the airflow is discharged;

an upstream side filter disposed on an upstream side of the fan in a direction of the airflow, the upstream side filter capturing the toner and allowing passage of the airflow; and a downstream side filter disposed on a downstream side of the discharge port in the direction of the airflow, the downstream side filter allowing the passage of the airflow discharged from the discharge port and capturing the toner, the downstream side filter having a cross section perpendicular to the direction of the airflow with a cross-sectional area that is larger than the discharge port, the downstream side filter having a facing surface disposed to be perpendicular to a discharge direction of the airflow discharged from the discharge port, and faces the discharge port in the discharge direction, a communication section including a communication space where communication between the discharge port and the downstream side filter is established and where the airflow flows, the facing surface of the downstream side filter facing the communication space, and the image forming apparatus further comprises a communication region changing section that changes an area of a communication region of the facing surface, the communication region being in communication with the communication space, the communication region changing section includes:

a partitioning member that defines a surface of the communication space along the discharge direction; and a movement unit that moves the partitioning member in a direction crossing the discharge direction, and the area of the communication region is changed by the movement of the partitioning member.

11. The image forming apparatus according to claim 10, wherein the discharge direction is along a horizontal plane, the facing surface is set to be wider than the discharge port in a vertical direction, a surface, of the partitioning member, facing the vertical direction defines the communication space, and the movement unit moves the partitioning member in the vertical direction.

12. The image forming apparatus according to claim 10, wherein the discharge direction is along a horizontal plane, the facing surface is set to be wider than the discharge port in a width direction perpendicular to the discharge direction and a vertical direction, a surface, of the partitioning member, facing the width direction defines the communication space, and the movement unit moves the partitioning member in the width direction.

13. The image forming apparatus according to claim 10, further comprising:

an airflow amount detector that is disposed on the upstream side of the fan in the direction of the airflow, and detects an amount of the airflow; and a controller that causes the communication region changing section to change the area of the communication region in accordance with a detection result of the airflow amount detector.

14. An image forming apparatus comprising:

an image forming section that forms a toner image on a sheet;

a toner collector including an inlet port; and a collection duct that collects unnecessary toner in or around the image forming section together with an airflow, so that the unnecessary toner and the airflow flow through the inlet port, wherein the toner collector includes:

a housing;

the inlet port which is opened in the housing and through which toner flows together with an airflow;

a fan that is disposed in the housing, and intakes and discharges the airflow having flowed in through the inlet port;

a discharge port which is provided to the fan and through which the airflow is discharged;

an upstream side filter that is disposed on an upstream side of the fan in a direction of the airflow, and captures the toner and allows passage of the airflow;

a downstream side filter that is disposed on a downstream side of the discharge port in the direction of the airflow, and allows the passage of the airflow discharged from the discharge port and captures the toner;

a communication section including a communication space where communication between the discharge port and the downstream side filter is established and where the airflow flows;

a communication region changing section; and a controller, wherein the downstream side filter having a cross section perpendicular to the direction of the airflow with a cross-sectional area that is larger than the discharge port, the downstream side filter includes a facing surface facing the communication space, the communication region changing section changes an area of a communication region of the facing surface, the communication region being in communication with the communication space, and the controller causes the communication region changing section to change the area of the communication region in accordance with use conditions of the image forming section.

15. The image forming apparatus according to claim 14, further comprising:

an image density detector that detects an image density of the toner image, wherein the controller causes the communication region changing section to change the area of the communication region in accordance with a detection result of the image density detector.

16. The image forming apparatus according to claim 15, wherein the controller sets the area of the communication region to be larger as the image density detected by the image density detector increases.

* * * * *